US011441288B2

(12) United States Patent
Herwig et al.

(10) Patent No.: US 11,441,288 B2
(45) Date of Patent: Sep. 13, 2022

(54) PILE AND METHOD OF INSTALLING

(71) Applicant: Innogy SE, Essen (DE)

(72) Inventors: Volker Herwig, Hamburg (DE); Benjamin Matlock, Hamburg (DE)

(73) Assignee: INNOGY SE, Essen (DE)

( * ) Notice: Subject to any disclaimer, the term of this patent is extended or adjusted under 35 U.S.C. 154(b) by 0 days.

(21) Appl. No.: 16/649,547

(22) PCT Filed: Jun. 11, 2018

(86) PCT No.: PCT/EP2018/065335
§ 371 (c)(1),
(2) Date: Mar. 20, 2020

(87) PCT Pub. No.: WO2019/057353
PCT Pub. Date: Mar. 28, 2019

(65) Prior Publication Data

US 2020/0308799 A1 Oct. 1, 2020

(30) Foreign Application Priority Data

Sep. 20, 2017 (DE) ..... 10 2017 121 760.6

(51) Int. Cl.
*E02D 27/12* (2006.01)
*E02D 27/42* (2006.01)
(Continued)

(52) U.S. Cl.
CPC ..... *E02D 27/425* (2013.01); *E02D 27/12* (2013.01); *E02B 2017/0065* (2013.01);
(Continued)

(58) Field of Classification Search
CPC ..... E02D 27/12; E02D 27/425; E02D 7/18; E02D 7/24; E02D 7/26; E02D 5/62; F05B 2240/95
See application file for complete search history.

(56) References Cited

U.S. PATENT DOCUMENTS 1,409,760 A * 3/1922 O'Marr ..... E02D 7/24 175/207
1,792,333 A * 2/1931 Takechi ..... B43L 13/004 405/232
(Continued)

FOREIGN PATENT DOCUMENTS

AU 2014282262 9/2016
DE 1129895 5/1962
(Continued)

OTHER PUBLICATIONS

English translation of International Report on Patentability from corresponding PCT Appln. No PCT/EP2018/065335, dated Dec. 10, 2019.
(Continued)

*Primary Examiner* — Benjamin F Fiorello
(74) *Attorney, Agent, or Firm* — Grossman, Tucker, Perreault & Pfleger, PLLC

(57) ABSTRACT

A method for installing a pile, in particular a monopile for a wind turbine, in a soil, comprising the method steps: —driving the pile into the soil using a vibration device; and—compacting soil material surrounding a lateral surface of the pile.

17 Claims, 6 Drawing Sheets

(51) Int. Cl.
*E02B 17/00* (2006.01)
*E02D 7/18* (2006.01)

(52) U.S. Cl.
CPC ..... *E02B 2017/0091* (2013.01); *E02D 7/18* (2013.01); *F05B 2240/95* (2013.01)

(56) References Cited

U.S. PATENT DOCUMENTS 2,063,142 A * 12/1936 Austermuhle ..... E02D 5/28 405/253
2,923,133 A * 2/1960 Muller ..... E02D 5/30 405/236
2,924,948 A * 2/1960 Mueller ..... E02D 5/62 405/236
3,064,438 A * 11/1962 Muller ..... E02D 5/62 405/236
3,277,968 A * 10/1966 Grimaud ..... E02D 5/56 173/216
3,394,766 A * 7/1968 Lebelle ..... E02D 7/18 173/49
3,693,364 A * 9/1972 Bodine ..... E02D 7/18 405/245
3,842,608 A * 10/1974 Turzillo ..... E02D 5/56 405/236
3,975,917 A * 8/1976 Asayama ..... E02D 5/54 405/232
4,165,198 A * 8/1979 Farmer ..... E02D 5/385 405/222
4,257,722 A * 3/1981 Nakajima ..... E02D 7/24 405/232
4,553,443 A * 11/1985 Rossfelder ..... B06B 1/161 173/147
4,603,748 A * 8/1986 Rossfelder ..... B06B 1/161 173/49
5,653,556 A * 8/1997 White ..... E02D 7/18 173/162.1
5,860,482 A * 1/1999 Gremillion ..... E21B 7/24 175/19
6,402,432 B1 * 6/2002 England ..... E02D 5/44 175/267
6,641,333 B2 * 11/2003 Bartlett ..... E02D 27/16 405/233
7,241,079 B2 * 7/2007 Francis ..... E02D 5/56 248/530
10,501,905 B2 * 12/2019 Han ..... E02D 5/54
2007/0277989 A1 * 12/2007 Hessels ..... E02D 7/10 173/128
2008/0019779 A1 * 1/2008 Henderson ..... E02D 5/38 405/237
2008/0193223 A1 * 8/2008 Wissmann ..... E02D 5/72 405/229
2009/0272617 A1 * 11/2009 Evarts ..... F16D 1/0847 192/110 R
2011/0110725 A1 * 5/2011 Evarts ..... E02D 7/18 405/232
2016/0340858 A1 * 11/2016 Revel-Muroz ..... E02D 7/02
2016/0348329 A1 * 12/2016 Takeshima ..... E02D 7/18

FOREIGN PATENT DOCUMENTS

DE 102015209661 12/2016
EP 2557232 2/2013
EP 3178996 A1 * 6/2017 ..... E02D 27/425
GB 2158493 11/1985
JP 3-286022 12/1991
WO 2014/203858 12/2014

OTHER PUBLICATIONS

English translation of International Search Report from corresponding PCT Appln No. PCT/EP2018/065335, dated Sep. 17, 2018.

* cited by examiner

PILE AND METHOD OF INSTALLING

FIELD

The present invention relates to a method for installing a pile, in particular a monopile for a wind turbine, in soil and to a pile, in particular a monopile, for a wind turbine.

BACKGROUND

The installation of piles in a bed or soil is generally carried out using impact or vibration driving methods. If the vibration technique is used for installing piles to an intended total depth, soil in the regions adjoining the pile may be locally loosened and/or liquefied if the soil is cohesionless and dense or very dense. This loosening and/or liquefaction results in diminished lateral pile bearing capacities.

Against this background, the underlying technical problem of the invention is to provide a method for installing a pile and a pile which do not exhibit the above-described disadvantages, or at least exhibit these to a lesser degree, and, in particular, enable increased lateral pile bearing capacity in cohesionless soils.

SUMMARY

According to a first aspect, the invention relates to a method for installing a pile, in particular a monopile for a wind turbine, in a soil, comprising the method steps:

driving the pile into the soil using a vibration device; and compacting soil material surrounding a lateral surface of the pile.

Compacting the soil material surrounding the lateral surface allows the lateral pile bearing capacity to be increased.

For example, the method can be used to install a pile for an offshore or onshore wind turbine.

In particular, it is possible to drive the pile into cohesionless soil. Cohesionless soil is essentially composed of sand and/or gravel, and in particular sand having a particle size of 0.2 to 1 mm in diameter, for example.

The soil material can be compacted by way of mechanical compaction, and in particular by the displacement of soil material. As an alternative or in addition, the compaction can be achieved as a result of a local change in the particle size distribution of the soil material.

Another embodiment of the method provides for the compaction of the soil material surrounding the lateral surface of the pile to comprise the following method step:

mechanically compacting the soil material by driving a collar surrounding the lateral surface of the pile at least in sections or by driving a local increase in diameter, such as a pile thickening, a pile widening or the like, into the soil.

The collar accordingly has a larger diameter than the pile and may effectuate axial displacement of the soil material along a driving direction or along a longitudinal axis of the pile.

The collar may, in particular, rest gap-free or flush against an outer lateral surface of the pile.

By way of the collar, a local compaction zone of compacted soil material which adjoins the collar can be formed.

An axial length of the compaction zone may be more than 1 m, and in particular more than 5 m.

According to another embodiment of the method, it is provided that an excitation frequency of the vibration device is reduced when the collar is being driven into the soil. By reducing the excitation frequency, an advancement in the region of an end face of the pile being driven into the soil can be reduced or set, thereby, however, resulting in increased compaction of the soil material in the region of the collar. After the pile has been driven to the intended mounting depth, the reduced excitation frequency can be maintained for a predefined period of time until the required degree of compaction across a required axial length of a compaction zone has been reached.

As was already mentioned above, as an alternative or in addition to mechanical compaction, compaction by a local change in the particle size distribution of the soil material can be carried out.

According to another embodiment of the method, it is provided that the compaction of the soil material surrounding the lateral surface of the pile comprises the following method step:

changing the particle size distribution of the soil material by injecting a fluid mixed with a filler, in particular in the region of an end face of the pile driven into the soil.

As a result of the injection of the fluid mixed with filler, it is possible to achieve grain refining, for example, so as to compact the soil material. In particular, the injected filler has a lesser fine to average particle size than the originally present soil material.

The filler can include particles having a diameter of 0.25 mm or less. It shall be understood that the diameter of the particles is selected as a function of the soil material to be compacted. As an alternative or in addition, the filler can comprise sand, cement or bentonite or consist of sand, cement or bentonite.

The particles can have a diameter of 0.125 mm or less.

The fluid can be water, for example.

It can be provided that the fluid is at least partially pumped off again and/or drains into the soil.

According to another embodiment, the method is characterized in that the injection is carried out by way of at least one pipe, which is attached to a lateral surface of the pile. The pipe can be welded to a lateral surface of the pile.

In particular, it can be provided that the injection is carried out by way of at least four pipes, which are attached to an inner and/or an outer lateral surface of the pile. In this way, the pipes can be integrated into the pile in a compact manner.

According to another embodiment of the method, it is provided that the following method step is carried out prior to the compaction of the soil material surrounding the lateral surface of the pile:

loosening and/or liquefying the soil material surrounding the lateral surface of the pile.

Loosening and/or liquefaction of the soil material can take place by the vibration of the pile. By loosening and/or liquefying and subsequently compacting the soil material, a lateral bearing capacity of the pile can be set in a targeted manner.

As an alternative, the method according to the invention can be used for the installation of overhead transmission line towers for a power grid.

According to a second aspect, the invention relates to a pile, in particular a monopile for a wind turbine, characterized by a collar or a local increase in diameter, such as a pile thickening, a pile widening or the like, for mechanically compacting soil material, wherein the collar or the local increase in diameter surrounds a lateral surface of the pile at least in sections, and/or at least one pipe attached to a lateral surface of the pile which is configured to inject a fluid mixed with a filler into a soil.

To the extent that the pile is driven into a soil by means of a vibration device to the intended total depth or a defined depth prior to reaching the total depth, the collar and/or the pipes can be used to compact adjoining soil material. The pile can, in particular, be configured for use in an above-described method.

It is possible to provide four or more pipes for injecting the fluid mixed with filler.

The pile can, in particular, be a monopile for an offshore or onshore wind turbine.

According to one embodiment of the pile, it is provided that the collar or the local increase in diameter is seated, at least in sections, in a soil in which the pile is installed when the pile is fully mounted. The collar thus forms part of the supporting structure formed by the pile.

It may be provided that the collar is wedge-shaped. For example, the collar or the local increase in diameter can be tapered, for example seen along a driving direction of the pile, or can be tapered seen counter to a driving direction of the pile.

It can be provided that the collar and/or the pile are welded to a lateral surface of the pile.

The collar has a larger diameter than the pile and may effectuate axial compression of the soil material along a driving direction or along a longitudinal axis of the pile.

The collar may, in particular, rest gap-free or flush against an outer lateral surface of the pile.

As an alternative, it may be provided to provide a local increase in diameter, such as a local thickening of the wall of the pile, instead of a collar, such as a circularly extending bulge or the like, which may be part of an outer lateral surface of the pile. In this case, the collar is not provided separately and welded on, but is an integral part and produced in one piece with the wall of the pile.

According to another embodiment of the pile, it is provided that a distance between an end face of the pile to be sunk into a soil and the collar or the local increase in diameter is 15 m or more. Seen along a driving direction, the collar is thus provided trailing the end face on the outer lateral surface.

The collar or the local increase in diameter can have an axial length of 0.1 m to 5 m. The collar or the local increase in diameter can have an axial length of more than 5 m. In this way, reliable compaction can be achieved.

The pile can be a substantially circular hollow profile, and in particular a steel pipe.

As a result, the pile can, for example, be a monopile for a wind turbine, which is known per se and which has been supplemented with additional elements for compaction.

As an alternative, the pile may also be a soil anchor for a jacket structure of a wind turbine or another mast or supporting structure. The pile can, in particular, be a mast for supporting a power supply line of a power grid.

BRIEF DESCRIPTION OF THE DRAWINGS

The invention will be described in greater detail hereafter based on a drawing showing exemplary embodiments. The drawings in each case show schematic illustrations.

DETAILED DESCRIPTION

Figure 1:
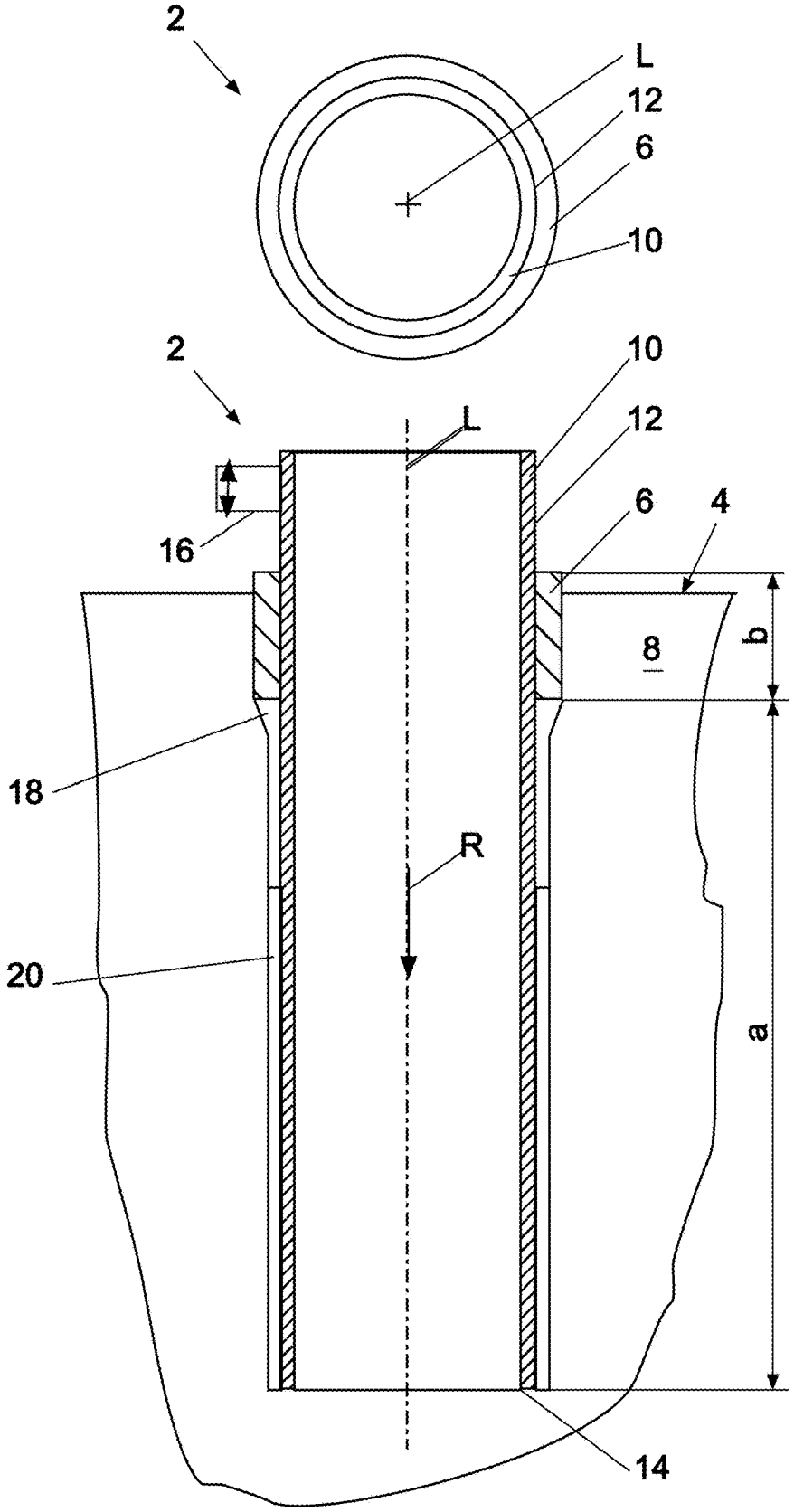
FIG. 1 shows a pile according to the invention in a top view and a longitudinal view.

FIG. 1 shows a pile 2 according to the invention in a top view and a longitudinal view.

The pile 2 is a monopile for a wind turbine. So as to improve clarity, only the portion of the monopile assigned to the soil 4 is shown.

The pile 2 includes a collar 6 for mechanically compacting soil material 8 of the soil 4. The collar 6 completely surrounds a lateral surface 12 formed on a wall 10 of the pile 2 on the circumference. According to alternative exemplary embodiments, it may be provided that the collar comprises a plurality of mutually spaced segments.

In the fully mounted state of the pile 2 shown in FIG. 1, the collar 6 is partially seated in the soil 4 in which the pile 2 is installed. In the present example, the collar 6 is welded to the wall 10 of the pile 2 in the region of the outer lateral surface 12.

In the shown example, a distance a between an end face 14 of the pile to be sunk into the soil 4 and the collar 6 is more than 15 m. In the present example, the collar 6 has an axial length b of 3 m. In the present example, the pile 2 is a substantially circular hollow profile made of steel. In the present example, the distance a and the length b are measured parallel to or along a driving direction R which, in turn, extends parallel to or along a longitudinal axis L of the pile 2.

So as to install the pile 2 in the soil 4, the pile 2 is initially driven or placed by vibration into the soil 4 using a vibration device 16. As soon as the collar 6 makes contact with the soil 4 as the pile 2 is being driven along the driving direction R, soil material is compacted in a compaction region 18 adjoining the collar 6 and the lateral surface 12. In a loosening region 20 adjoining the compaction region 18, the soil material 8 remains in the loosened state created by the vibrations of the pile 2.

Prior to the compaction of the soil material 8 surrounding the lateral surface 12 of the pile 2, the soil material 8 thus is loosened and/or liquefied by the vibrations of the pile 2 generated by way of the vibration device 16.

So as to support the compaction of the soil material 8 in the compaction region 18 and increase the axial length of the compaction region 18, an excitation frequency of the vibration device 16 can be decreased while the collar 6 is being driven into the soil 4. This yields the increased compaction region 18 shown in FIG. 2.

Figure 3:
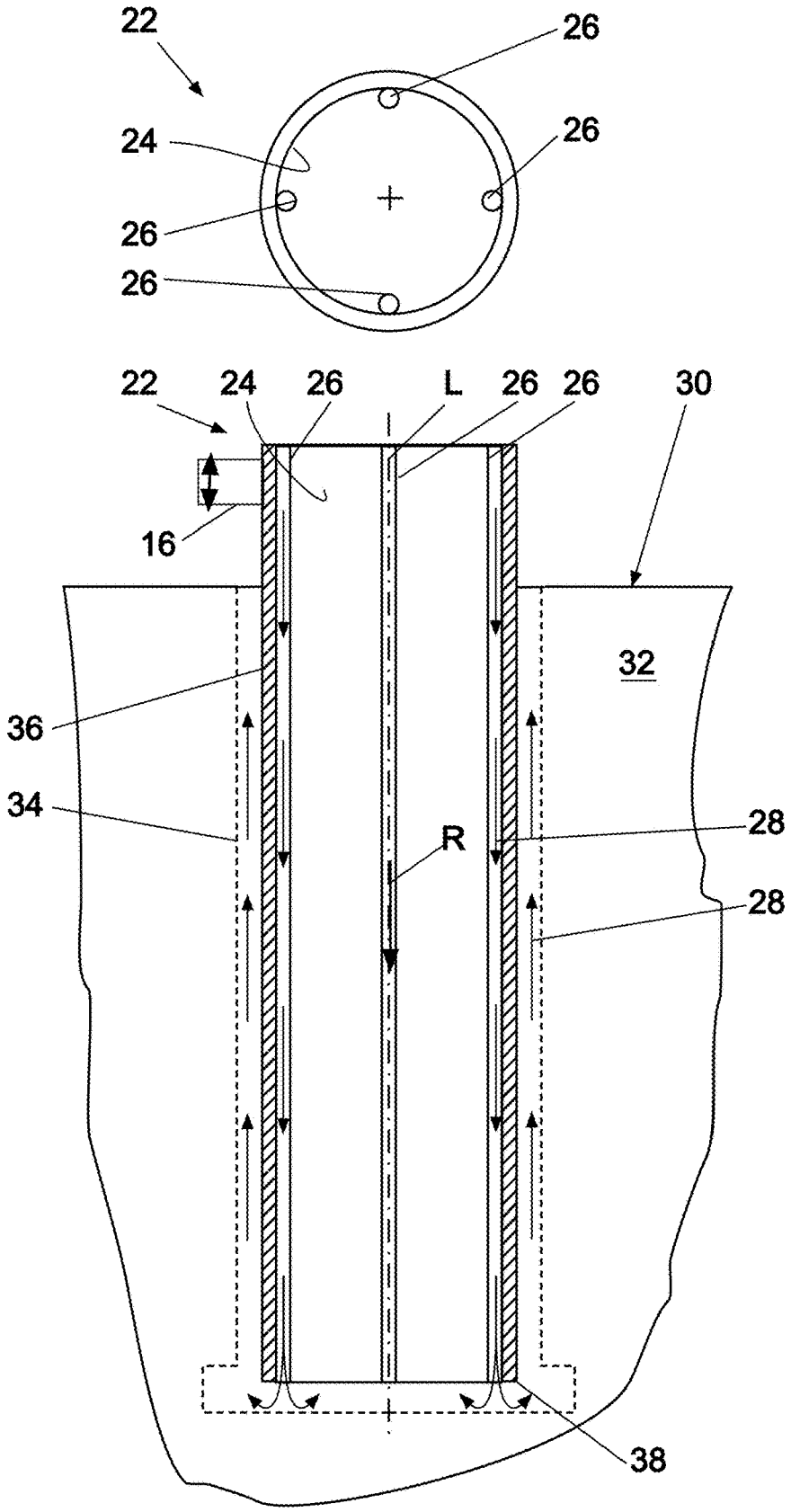
FIG. 3 shows another pile according to the invention in a top view and a longitudinal view.

FIG. 3 shows an alternative design according to the invention of a pile 22. The pile 22 is again a monopile 22 for a wind turbine, which is shown in a top view and a longitudinal view.

The pile 22 includes four pipes 26 attached to an inner lateral surface 24 of the pile 22. The pipes 26 are configured to inject a fluid 28 mixed with a filler into a soil 30. The pipes 26 are welded to the inner lateral surface 24. The injection of the fluid 28 mixed with filler into the soil 30 is carried out, in particular, in the region of an end face 38 of the pile 22 driven into the soil.

The filler entrained with the fluid 28 has particles that have a diameter of less than 0.25 mm. As a result of the introduction of the fluid 28 mixed with filler, a particle size distribution of a soil material 32 of the soil 30 is changed in a compaction region 34, wherein overall better graded material having enhanced compaction properties is created. In this way, compaction of the soil material 32 is achieved in the compaction region 34 adjoining an outer lateral surface 36, as indicated by the dotted line.

Figure 4:
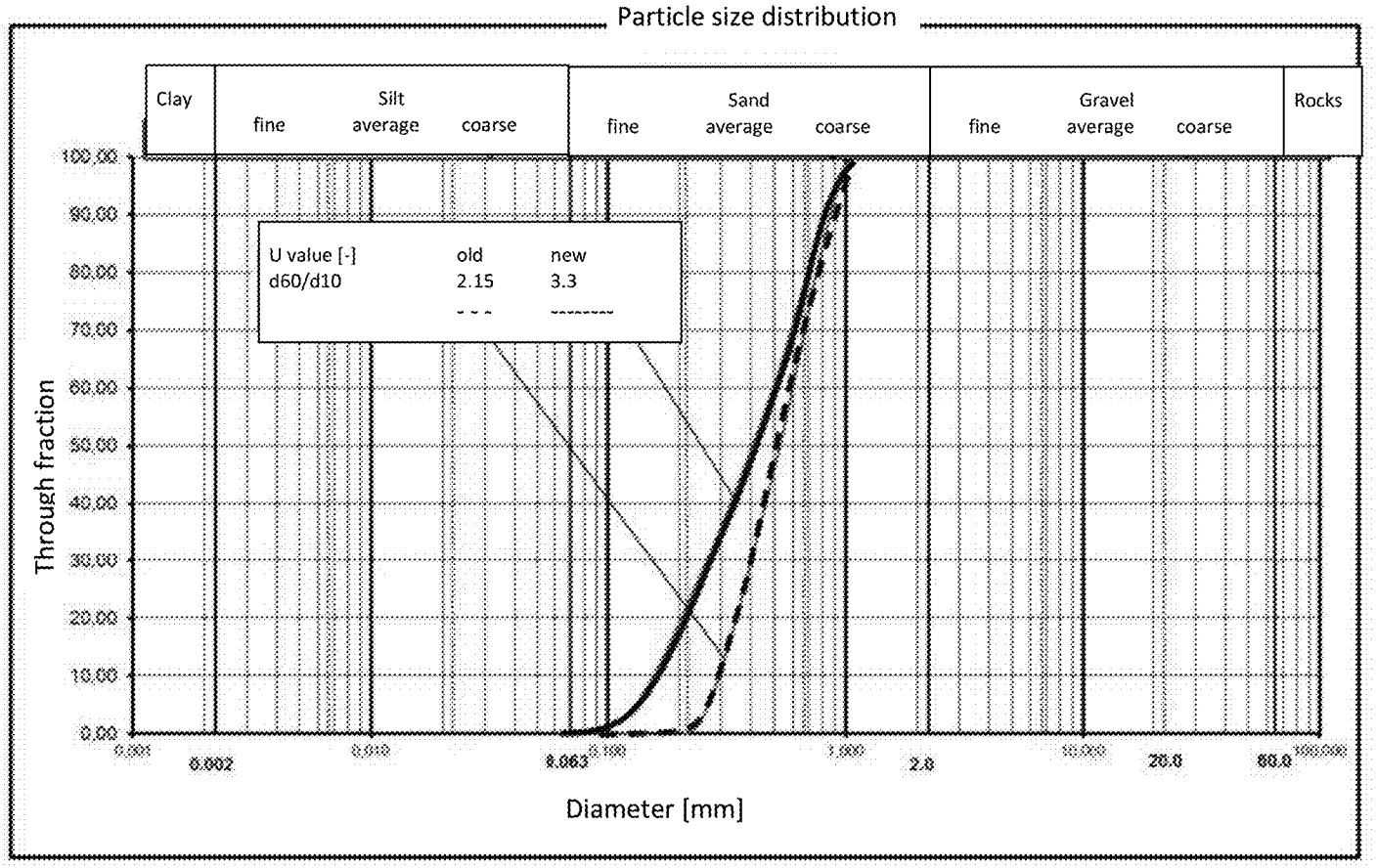
FIG. 4 shows a diagram for changing the particle size distribution.

FIG. 4 shows a particle distribution before and after the introduction of the fluid 28 mixed with filler by way of example. The solid line "new" describes the state after the introduction of the fluid 28 mixed with filler, while the dotted line "old" describes the particle size distribution before the introduction of the fluid mixed with filler. It is apparent that a shift of the distribution toward a wide gradation of the particle size has taken place.

Figure 2:
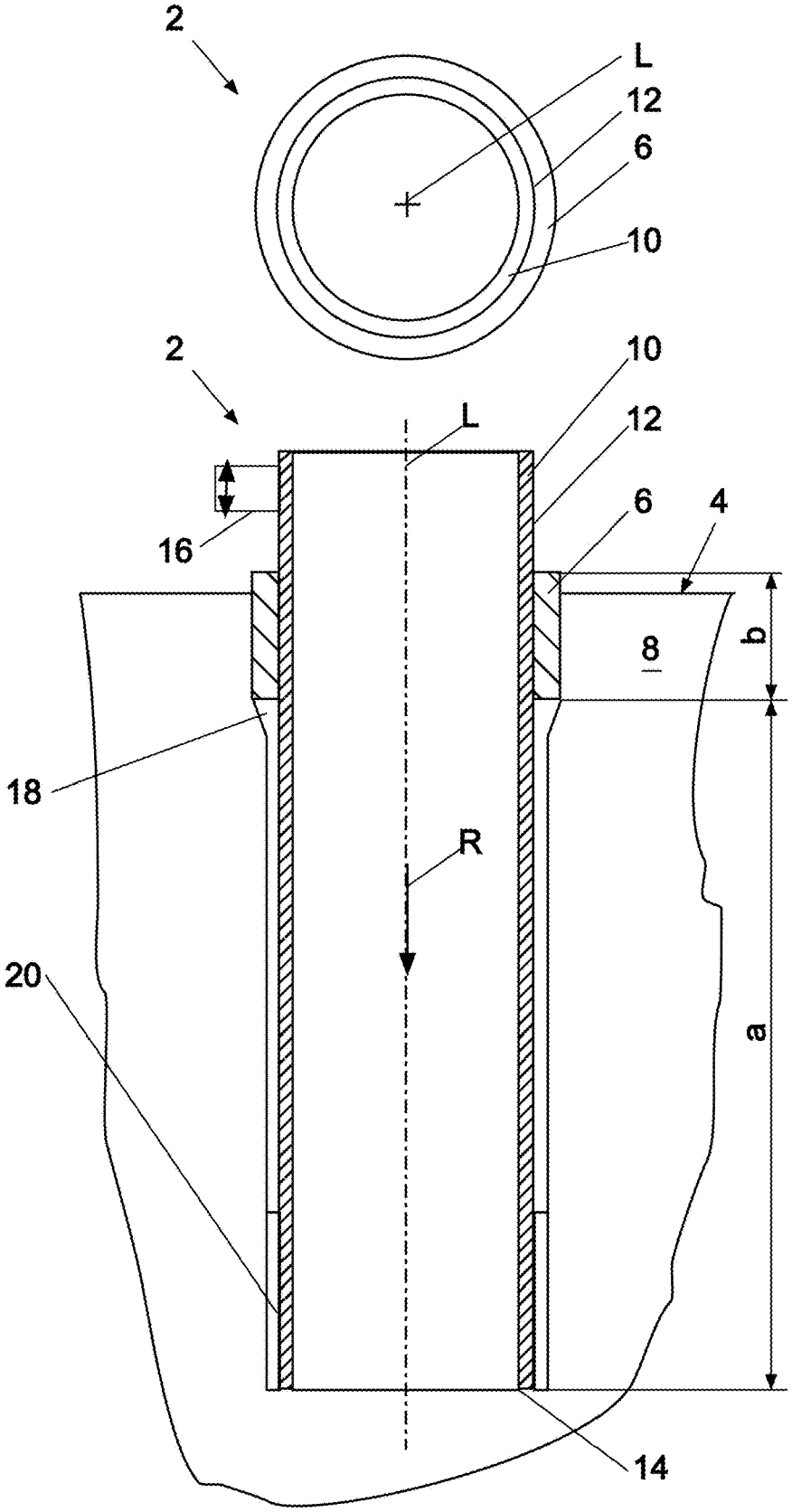
FIG. 2 shows the pile from FIG. 1 in a top view and a longitudinal view.
Figure 5:
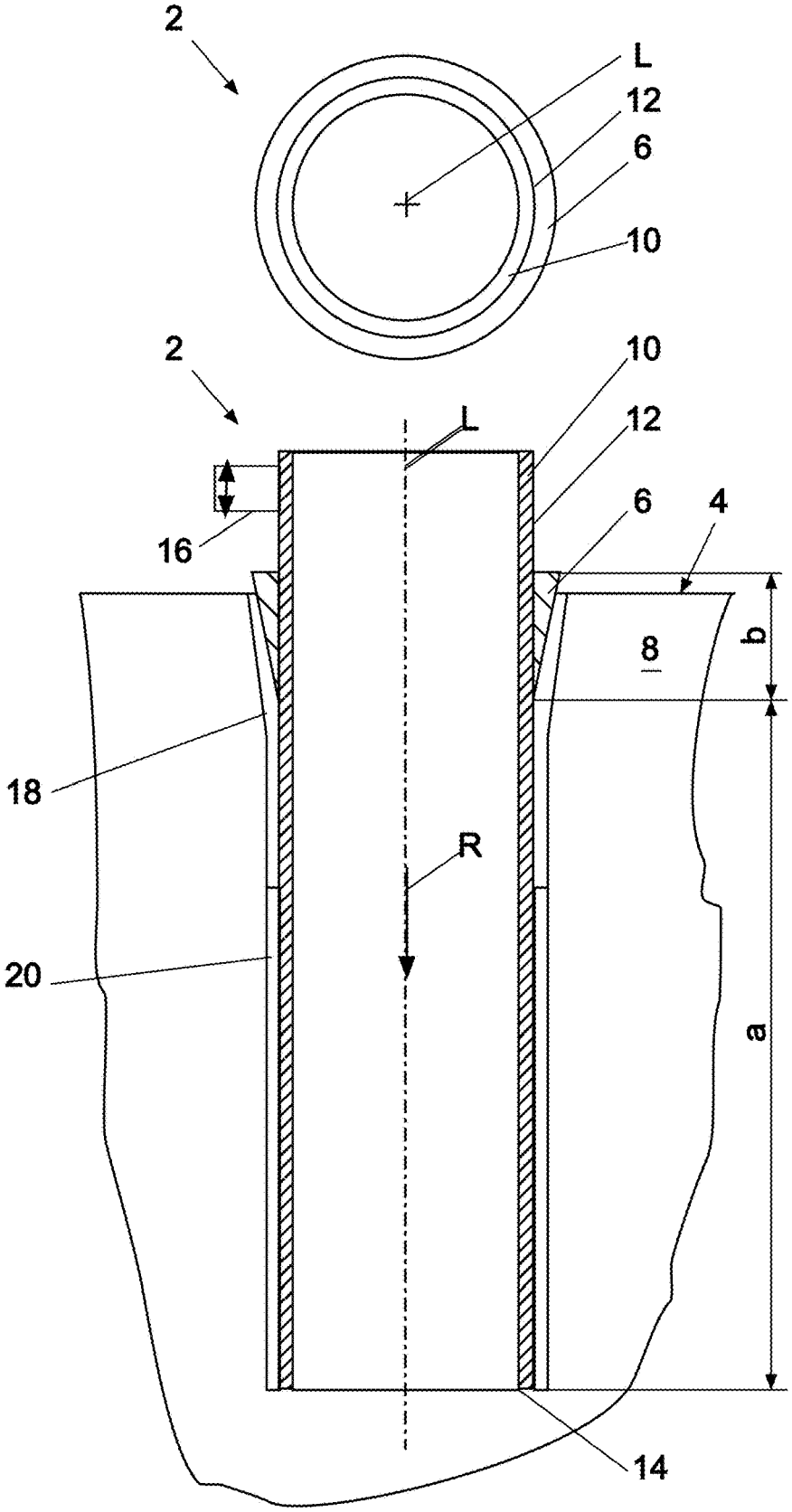
FIG. 5 shows another pile according to the invention in a top view and a longitudinal view.
Figure 6:
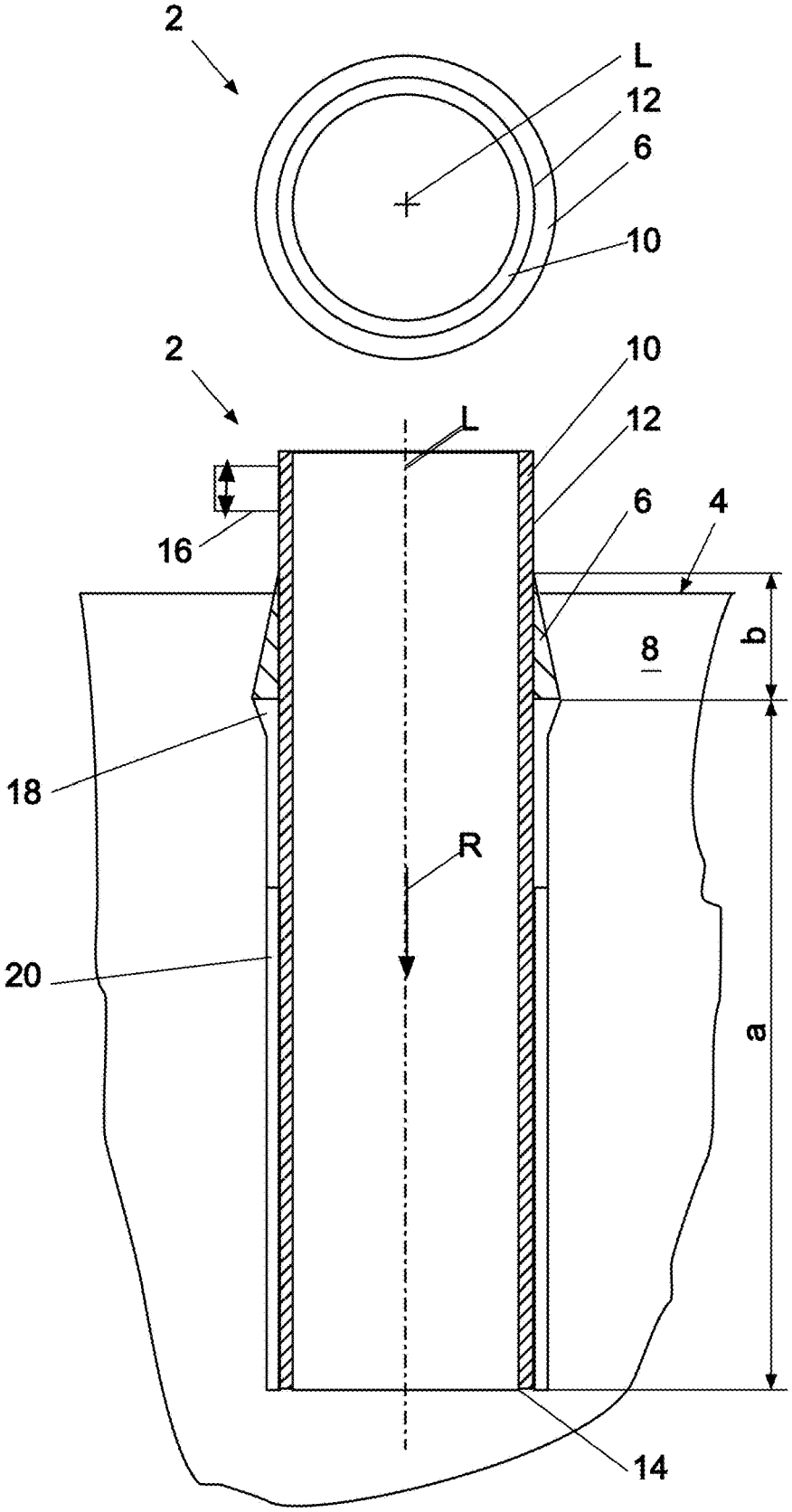
FIG. 6 shows another pile according to the invention in a top view and a longitudinal view.

FIGS. 5 and 6 show further variants of piles 2, which differ from FIGS. 1 and 2 by a wedge shape of the collar 6.

It shall be understood that the piping of the pile 22 shown in FIG. 3 can be combined with a collar 6 of the examples from FIG. 1, FIG. 2, FIG. 5 and FIG. 6, so that the advantages of mechanical compaction can be combined with the wide gradation of the particle size, in particular the introduction of an additive such as sand, bentonite or cement, so as to increase a lateral bearing capacity of a pile.

REFERENCE NUMERALS

2 pile
4 soil
6 collar
8 soil material
10 wall
12 lateral surface
14 end face
16 vibration device
18 compaction region
20 loosening region
22 pile
24 inner lateral surface
26 pipe
28 fluid (mixed with filler)
30 soil
32 soil material
34 compaction region
a distance
b length
L longitudinal axis
R driving direction

What is claimed is:

1. A method for installing a pile having a bottom, comprising a hollow monopile, for a wind turbine in soil, the method comprising:

driving the hollow monopile into the soil using a vibration device, the hollow monopile having a bottom with an open end face disposed at a lowermost point of the pile;

compacting soil material surrounding at least a section of a lateral surface of the hollow monopile; and wherein the compacting of the soil material surrounding at least the section of the lateral surface of the hollow monopile further comprises mechanically compacting the soil material by at least one of driving a collar coupled to the monopile into the soil or driving a local increase in diameter of the pile into the soil, and wherein the method further comprises injecting a fluid mixed with a filler into the soil at the lowermost point of the pile by at least one pipe that is disposed within the hollow monopile and extends up to the lowermost point of the pile.

2. The method according to claim 1, further comprising:

decreasing an excitation frequency of the vibration device while at least one of the collar or the local increase in diameter is being driven into the soil.

3. The method according to claim 1, further comprising:

changing a particle size distribution of the soil material with the fluid mixed with the filler.

4. The method according to claim 1, wherein:

the filler includes particles having a diameter of 0.25 mm or less; and/or the filler comprises at least one of sand, cement or bentonite, or consists of at least one of sand, cement or bentonite.

5. The method according to claim 1, wherein:

the at least one pipe is attached to the monopile.

6. The method according to claim 1, further comprising:

loosening and/or liquefying the soil material surrounding the lateral surface of the monopile prior to the compacting of the soil material surrounding the lateral surface of the monopile.

7. A pile having a bottom, comprising:

a hollow monopile having a bottom with an open end face disposed at a lowermost point of the pile;

at least one of a collar coupled to the monopile or a local increase in diameter of the pile, configured to mechanically compact soil material, wherein the at least one of the collar or the local increase in diameter surrounds at least a section of a lateral surface thereof; and at least one pipe attached to the monopile, which is configured to inject a fluid mixed with a filler into soil at the lowermost point of the pile, wherein the at least one pipe is disposed within the hollow monopile and extends up to the lowermost point of the pile.

8. The pile according to claim 7, wherein:

the at least one of the collar or the local increase in diameter is configured to be at least partially seated in soil when the pile is fully mounted.

9. The pile according to claim 7, wherein:

a distance between an end face of the pile to be sunk into soil and the at least one of the collar or the local increase in diameter is 15 m or more.

10. The pile according to claim 7, wherein:

the at least one of the collar or the local increase in diameter has an axial length of 1 m to 5 m.

11. The pile according to claim 7, wherein:

the monopile has a circular hollow profile.

12. The pile according to claim 7, wherein:

the monopile comprises a steel pipe.

13. The pile according to claim 7, wherein:

the collar is wedge-shaped.

14. The pile according to claim 7, wherein:

at least one of the collar or the at least one pipe is/are welded to the monopile.

15. The pile according to claim 7, wherein:

the at least one of a collar coupled to the monopile or a local increase in diameter of the pile comprises the collar coupled to the monopile; and the lateral surface of the monopile is an outer circumferential surface of the monopile; and the collar extends circumferentially around at least a section of the outer circumferential surface of the monopile.

16. The pile according to claim 15, wherein:

the collar comprises an annular ring.

17. The pile according to claim 15, wherein:

the collar extends circumferentially around the outer circumferential surface of the monopile in a closed loop.

* * * * *